US007788737B2

(12) United States Patent
Baker et al.

(10) Patent No.: US 7,788,737 B2
(45) Date of Patent: Sep. 7, 2010

(54) CUT RESISTANT GLOVE AND APPAREL

(75) Inventors: Jason Alan Baker, Alpharetta, GA (US); Matthew Lawrence Wagner, Canton, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 961 days.

(21) Appl. No.: 11/529,931

(22) Filed: Sep. 29, 2006

(65) Prior Publication Data

US 2008/0083050 A1 Apr. 10, 2008

Related U.S. Application Data

(60) Provisional application No. 60/748,549, filed on Dec. 8, 2005.

(51) Int. Cl.
*A41D 19/00* (2006.01)

(52) U.S. Cl. ..... 2/161.6

(58) Field of Classification Search ..... 2/161.1, 2/161.6, 167, 16, 20, 163; 427/513
See application file for complete search history.

(56) References Cited

U.S. PATENT DOCUMENTS

| | | | | | |
|---|---|---|---|---|---|
| 2,058,821 | A * | 10/1936 | Peck | 428/701 |
| 2,060,961 | A * | 11/1936 | Tillotson | 427/288 |
| 3,341,861 | A * | 9/1967 | Robbins | 2/163 |
| 3,649,967 | A * | 3/1972 | Millman | 2/161.3 |
| 4,084,265 | A * | 4/1978 | Anfelt | 2/163 |
| 4,359,783 | A | 11/1982 | Andrews | |
| 4,371,988 | A * | 2/1983 | Berend | 2/167 |
| 5,459,880 | A * | 10/1995 | Sakaki et al. | 2/168 |
| 5,500,956 | A * | 3/1996 | Schulkin et al. | 2/161.1 |
| 5,948,707 | A * | 9/1999 | Crawley et al. | 442/101 |
| 6,374,417 | B1 * | 4/2002 | Stagnitta | 2/161.8 |
| 6,591,427 | B1 * | 7/2003 | Bennett | 2/161.8 |
| 2005/0177923 | A1 * | 8/2005 | Simic | 2/161.6 |

FOREIGN PATENT DOCUMENTS

| | | | |
|---|---|---|---|
| JP | 60224804 | A | 11/1985 |
| JP | 11140716 | A | 5/1999 |
| JP | 11256411 | | 9/1999 |
| JP | 2002020916 | | 1/2002 |

OTHER PUBLICATIONS

"Best Cut Resistant Gloves," Dec. 21, 2004, Internet web pages, http://www.westernsafety.com/Best4.html, viewed and printed Mar. 1, 2007, pp. 1-4.

(Continued)

*Primary Examiner*—Katherine Moran
(74) *Attorney, Agent, or Firm*—Nathan P. Hendon; Sue C. Watson

(57) ABSTRACT

A glove or apparel formed at least partially from a knitted thread substrate and including areas on an outer surface which has a substantially continuous surface surrounding ends of the finger portions and thumb portion of the glove and areas which have a substantially non-continuous surface positioned over the palm portion and the back of the hand portion of the glove.

24 Claims, 5 Drawing Sheets

OTHER PUBLICATIONS

"Reversible KEVLAR® Machine Knit Gloves, Nitrile Dot," Jan. 26, 2005, Internet web page, http://www.magidglove.com/product.asp, viewed and printed Mar. 1, 2007, 1 page.

"Dong Won Catalogue", Feb. 7, 2005, Internet web pages, http://www.dwglove.com/cataesd.htm, viewed and printed Mar. 1, 2007, 2 pages.

"Polyethylen—U.H.M.W. (UHMW PE)—Materialinformationen," Feb. 20, 2005, Internet web pages, http://www.goodfellow.com/csp/active/STATIC/G/Polyethylen, viewed and printed Mar. 2, 2007, pp. 1-4.

"Taesung Mfg. Co., Ltd.," Jul. 28, 2005, Internet web pages, http://www.ecplaza.net/tradeleads/seller/2558096/work_gloves_punbr.html, viewed and printed Mar. 1, 2007, 2 pages.

"Samwha Clean Glove—PU Coated Fingertip With PVC Dotted Nylon Glove", Internet web pages, http://www.alibaba.com/catalog/11645074/PU_Coated_Fingertip_With_PVC_Dotted_Nylong_Glove.html, viewed and printed Mar. 1, 2007, 2 pages.

* cited by examiner

CUT RESISTANT GLOVE AND APPAREL

CROSS-REFERENCE TO RELATED APPLICATIONS

This application claims priority to U.S. Ser. No. 60,748,549, entitled "Cut Resistant Glove And Apparel," by Jason A. Baker, et al., filed Dec. 8, 2005.

BACKGROUND OF THE INVENTION

This invention relates to methods for producing a laminate useful in the manufacture of wearing apparel, for example, and to laminates so produced wherein the apparel includes at least one abrasion resistant and/or cut resistant surface.

Breathable gloves having finger surfaces that provide a good grip are highly desirable in an industrial environment. Breathability of such a glove or apparel, however, often greatly reduces the cut resistance of such gloves or apparel. Many such breathable gloves are formed from a web of material, desirably a knitted web. While a coating or laminate on a portion of the web, such as at least a portion of the fingers, thumb and palm, provides some protection and cut resistance, the cut resistance is low. This is because the web, as well as the coating or laminate, must be sufficiently thin to provide dexterity and grip to a user wearing the gloves. Further, often the back or the hand covered by the glove only is covered by a web, to promote breathability and greater flexibility of the glove. The web, however, must be sufficiently thin as well to promote flexibility and dexterity, and therefore provides little resistance to cuts.

A breathable glove and other apparel providing dexterity, flexibility, and greater cut resistance is highly desirable. Such a glove would desirably provide substantial breathability of both front and back surfaces (i.e., surfaces covering the palm and the back of the hand, respectively), as well as great dexterity for for joint movement of the hand and each finger and thumb as well as substantial flexibility overall. Such a glove and other apparel would desirably be an ambidextrous glove or apparel which could be placed on either hand with equal protection, breathability, dexterity and flexibility.

Definitions

As used here, the phrase "substantially continuous surface" refers to a surface wherein the underlying substrate is not visually discernable to the eye of an observer.

As used herein, the phrase "substantially non-continuous surface" refers to a surface having a plurality of spaced-apart dots wherein a plurality of areas positioned between the dots show the substrate which is visually discernable by the eye of an observer.

As used herein, the terms "form," "forms," "former," and "formers" refers to artificially constructed human hands which are used to manufacture gloves.

As used herein, the term "substantially" refers to something which is done to a great extent or degree; a significant or great amount; for example, as used herein "substantially" as applied to "substantially" covered means that a thing is at least 90% covered.

As used herein, the term "about" refers to an amount that is plus or minus 10 percent of a stated or implied range.

These terms may be defined with additional language in the remaining portions of the specification.

SUMMARY OF THE INVENTION

In response to the difficulties and problems discussed above, an item of apparel including a glove is provided. The glove comprises a substrate configured to include four fingers portions, a thumb portion, a palm portion and a back of hand portion which cooperate to cover a human hand. Each finger portion and thumb portion includes a substantially continuous surface positioned upon the substrate and surrounding each end of each respective finger portion and thumb portion. A non-continuous surface substantially is also positioned on the substrate and covers the palm portion and the back of hand portion. The glove is formed to be an ambidextrous glove.

DETAILED DESCRIPTION

Figure 1:
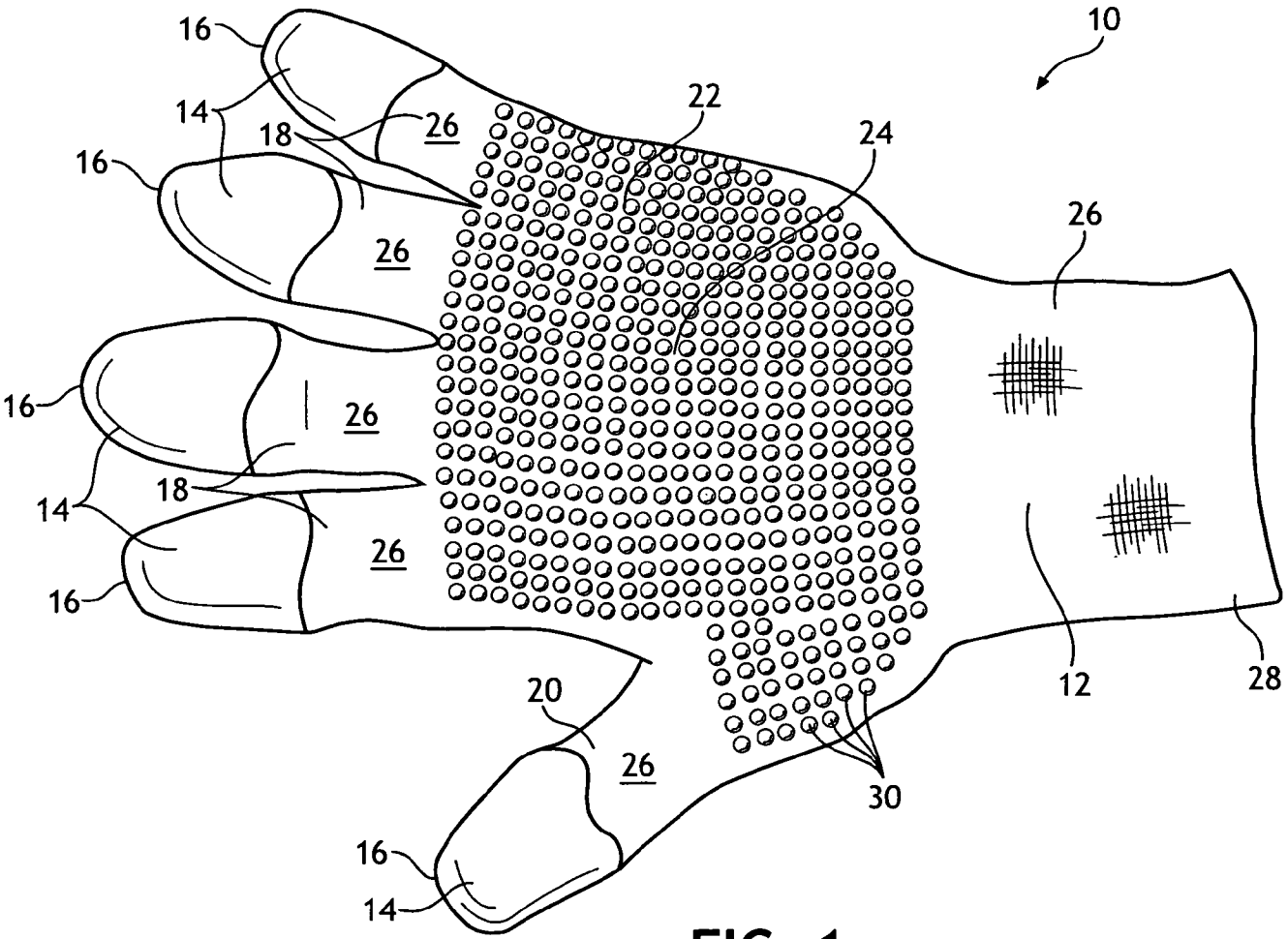
FIG. 1 is a top plan view of an embodiment of one item of apparel of the present invention, in this instance a glove, showing one side of the glove.
Figure 2:
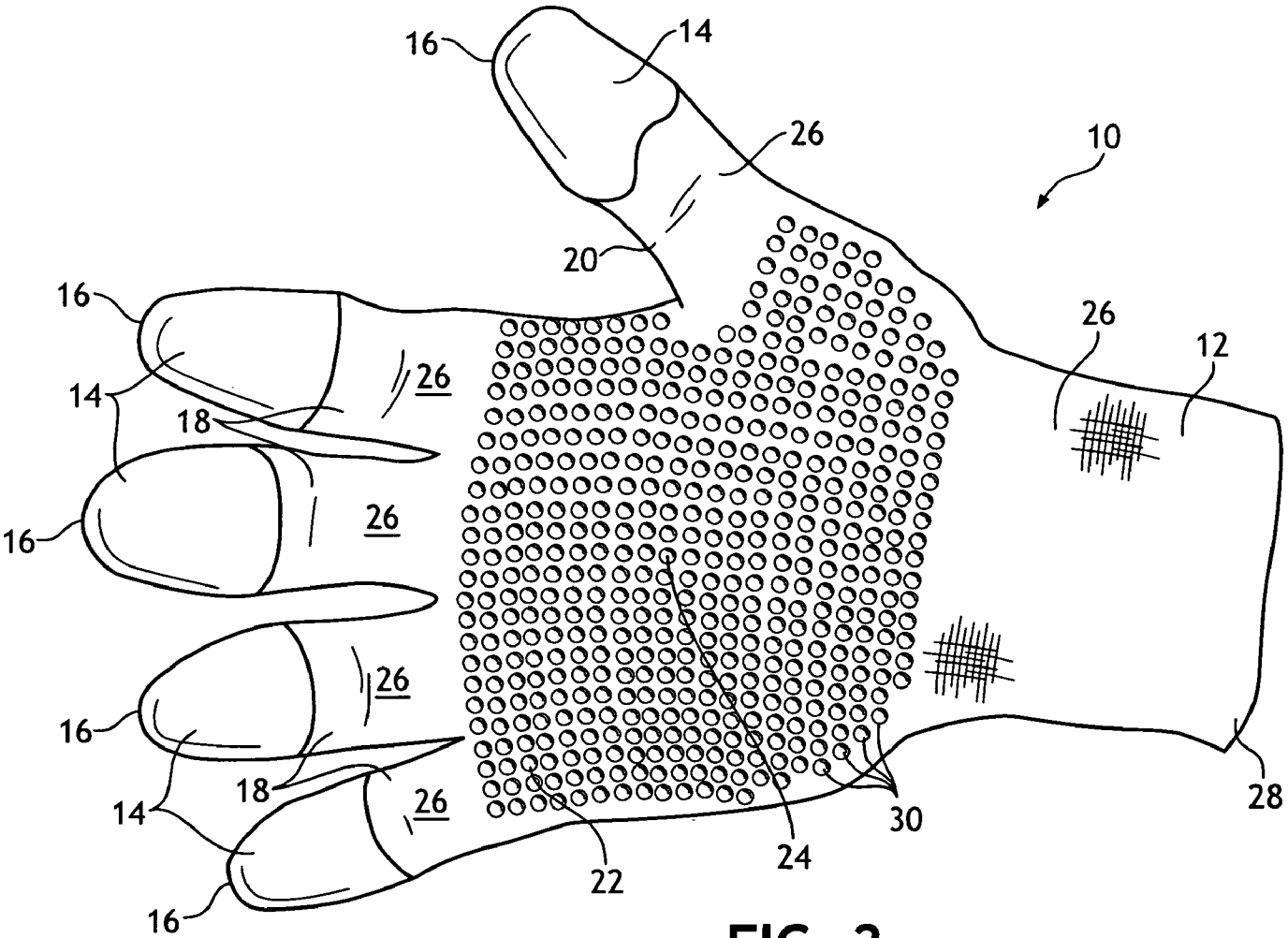
FIG. 2 is top plan view of the embodiment of FIG. 1, but showing an opposite side of the glove.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to FIGS. 1-5, a work glove 10 of the present invention is illustrated. As shown best in FIGS. 1-4, the work glove 10 includes an outer surface 12 upon which various coatings have been applied to provide various surfaces. One substantially continuous surface 14 is desirably provided over each end 16 of each finger portion 18 and thumb portion 20 of the glove 10. This substantially continuous surface surrounds and covers the entire end of each finger of a wearer's fingers and thumb, desirably from each end of each finger or thumb to at least the first joint adjacent each end thereof. Another substantially non-continuous surface 22 is desirably provided over a substrate or an outer surface 12 of the glove 10, which is positioned to cover a central area 24 which may include the palm or the back of the hand of a user, depending upon which hand a user puts the glove 10 on. A plurality of areas 26 which do not have coatings may also, but not by way of limitation, be provided. A cuff 28 may also be provided. The cuff 28 may be turned back to overlap itself (not shown), or may be hemmed without an overlap.

In the present embodiment, which utilizes a knitted glove as illustrated in FIGS. 1-4, the glove 10 is positioned on or manufactured on a form or former, such as a hand form (not shown). Then, for example, but not by way of limitation, a portion of the outer surface 12 of each glove 10 on each form is dipped into a foamed mixture. That is, the ends 16 of the finger portions 18 and thumb portion 20 are is desirably dipped into the foamed mixture to create a coating providing a substantially continuous surface 14 thereon.

Figure 5:
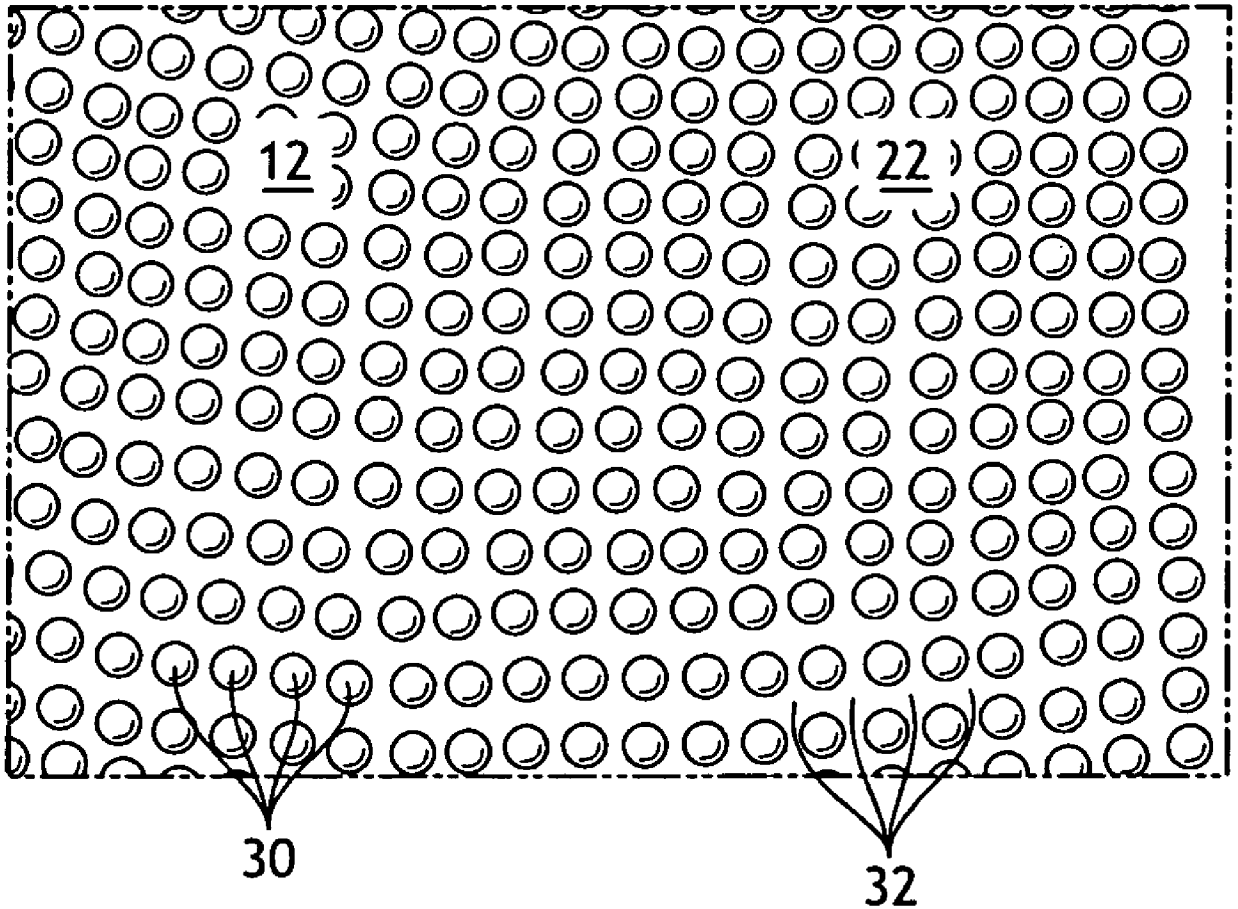
FIG. 5 is a partial top plan view of the dotted pattern having spaces in between of the glove shown in FIGS. 1-4.

The foamed mixture, or another substance, as described herein, may also be applied to any portion(s) of the outer surface 12 of each glove 10 via a plurality of "dots" having a certain limited area of space, as best shown in FIG. 5. Desirably, each protective dot 30 is spaced-apart from every other dot 30 to provide an area of increased protection against cuts and abrasion, while still maintaining flexibility, dexterity and breathability of that area of the glove 10. That is, there are a plurality of areas 32 surrounded by dots 30 which have no coating. This non-continuous surface 22 provides a non-continuous coverage via a plurality of dots 30 which provide these features.

It will be understood that the plurality of dots 30 may be provided in any form or configuration and/or any combination of configuration(s). That is, the generally round, semi-hemispherical plurality of dots 30 shown in the present embodiment are but one non-limiting example. Further, the plurality of areas 32 also may form any single or combination of configuration(s), and the present example is intended as a non-limiting example.

The plurality of dots 30 may be formed from a number of different materials, including, but not by way of limitation, nylon, vinyl, plastic, such as polypropylene, polyethylene, acrylonitrile latex, polyvinyl chloride latex, polyurethane latex, natural rubber, and so forth. Each of the plurality of dots 30 is desirably about 1 to about 5 mm in diameter. More desirably, each dot is about 1 to about 3 mm in diameter. Desirably, each dot has a height of about 0.5 to about 2 mm.

Spacing of the plurality of dots 30 relative to each other is also important. Each dot 30 is desirably spaced about 1 to about 5 mm apart. Even more desirably, each dot is spaced about 1 to about 3 mm apart.

The substantially non-continuous surface 22 desirably covers about 50 to about 100 percent of at least one central area 24 (palm portion 34 or back of the hand portion 36) of each glove 10. Desirably, the non-continuous surface 22 covers about 50 to about 100 percent of both central areas 24, that is, the area 34 and the back of the hand area 36 of each glove 10. Even more desirably, the non-continuous surface 22 covers about 80 to 100 percent of both central areas 24.

Figure 3:
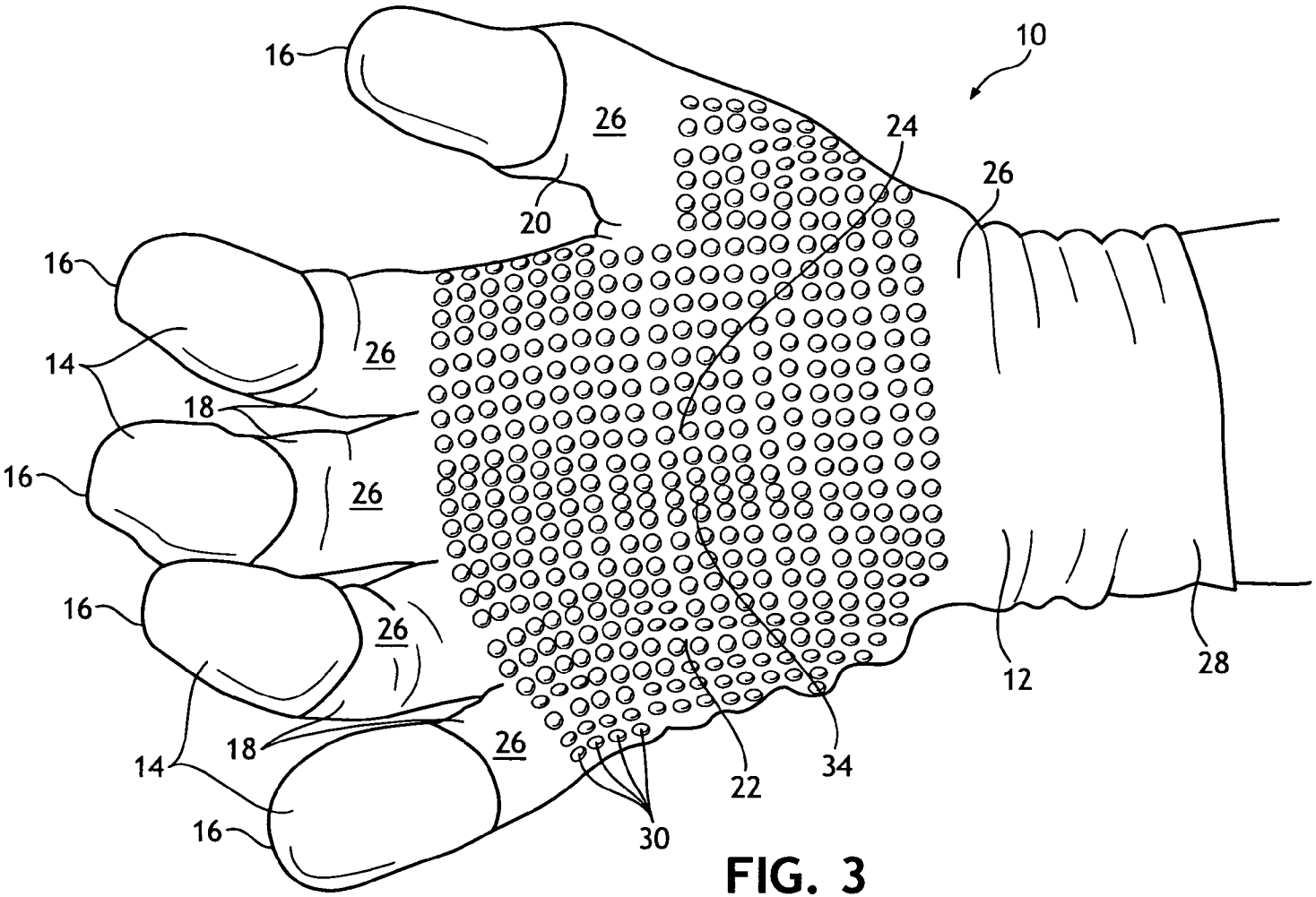
FIG. 3 is a top perspective view of the side of the glove shown in FIG. 2, but showing a hand positioned in the glove, the hand and glove positioned with the palm of the user positioned in an upward position.
Figure 4:
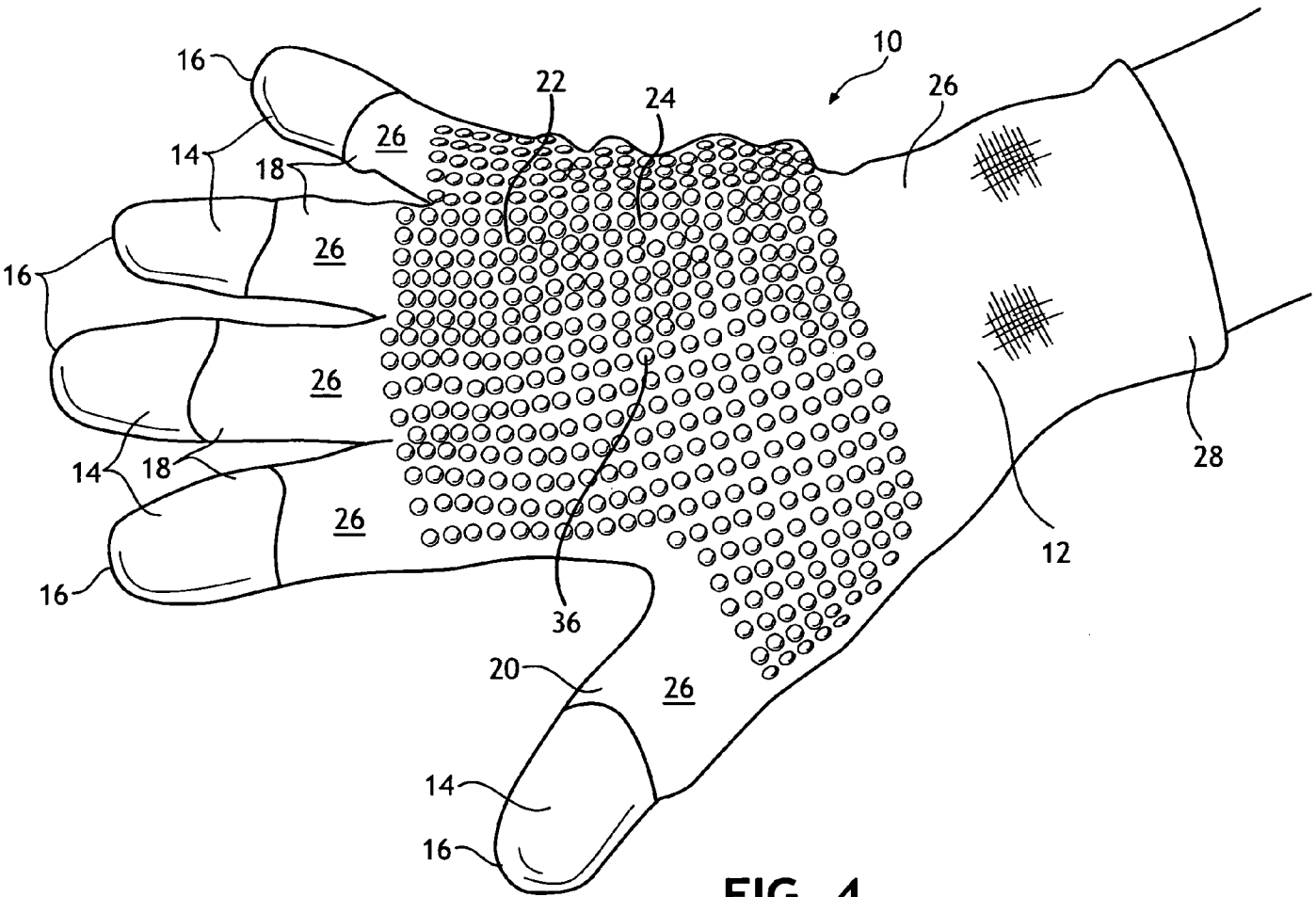
FIG. 4 is a top perspective view of the side of the glove shown in FIG. 1, but showing a hand positioned in the glove, the hand and glove positioned with the back of the user's hand positioned in an upward position.

A plurality of uncoated areas 26 may be provided between the substantially continuous surface 14 on each finger portion 18 and thumb portion 20 and the substantially non-continuous surface 22 on the central area(s) 24. The plurality of uncoated areas 26 may also include the portion of the glove 10 that covers a wrist of a user (FIGS. 3 and 4). Alternatively, one or more of these areas 26 may include the substantially non-continuous surface 22 provided by a plurality of dots 30 instead (not shown). Desirably, uncoated area(s) 26 of the substrate are positioned, but not by way of limitation, between an end of each substantially continuous surface 14 and the substantially non-continuous surface 22 positioned on the palm portion 34 and the back of hand portion 36, the uncoated area(s) 26 of substrate surrounding at least a portion of each finger portion 18 and thumb portion 20.

Each end 16 of each finger portion 18 and thumb portion 20 is desirably coated with a substance which provides a continuous surface 14 having an average thickness in a range of about 0.0025 inch to about 0.03 inch. This thickness is most desirable when a acrylonitrile coating is utilized. The combined thickness of both glove 10 and continuous surface 14 is desirably in a range of about 0.02 inch to about 0.08 inch. The depth of the continuous surface 14 applied to each end 16 of each finger portion 18 and thumb portion 20 (that is, from the end 16 of each finger portion 18 and thumb portion 20 and extending towards the central area 24) is in a range of about 1 to about 7 cm.

Various laminates may be used for the continuous and/or non-continuous surfaces 14, 22. One laminate includes a porous surface produced initially by foaming which cells then break or collapse, and which surface is useful as a gripping surface for the work environment, and the method of the invention is such that the surface may be controlled to have a lesser or greater degree of abrasion resistance, as required for the subsequent use of the article involved.

The glove 10 or apparel includes a substrate which desirably may include a woven web and/or a non-woven web. Non-woven webs may include, but not by way of limitation, spun bond non-woven materials and/or melt-blown non-woven materials. One desirable web would be formed from a knit, desirably, but not by way of limitation, a seamless knit. The glove 10 or apparel may be formed partially and/or substantially from any knitted material. One desirable knit may include a ultra high molecular weight polyethylene (UHMPE). UHMPE materials include DYNEEMA™ available from DMS Corporation, SPECTRA™, SNIA®, TEKMILON®, and so forth. Desirably, such knitted materials are combined with nylon, KEVLAR® or NOMEX®, both of which are products of DuPont, and/or stainless steel thread to form a composite knitted substrate thread or material. The composite thread or material is desirably formed into a glove or apparel. The composite thread or material may be formed into a seamless knitted glove using a seamless knit machine.

The substrate or composite thread or material may also include other materials; alternatively, other materials may be substituted for those previously mentioned. Such other materials may include polyolefins, such as, for example, but not by way of limitation, polypropylene, polyethylene, copolymers of acrylic acid, such as polyacrylonitrile, and so forth. In addition, such other materials may also include one or more of natural and/or synthetic fibers or blends thereof including, for example, polyester, polyamides, cotton, a polyester-cotton blend, and/or wool.

Desirably, as described previously herein, one or more laminates are applied to at least a portion of the glove or apparel. One laminate includes a porous surface produced initially by foaming which cells then break or collapse, and which surface is useful as a gripping surface for the work environment. The application of the laminate may be controlled such that the surface may be controlled to have a lesser or greater degree of abrasion resistance, dexterity, flexibility, breathability, cut resistance, and so forth as required for the subsequent use of the glove or apparel involved.

The application of the one or more laminates to the present glove 10 or apparel provides a substantially increased gripping action, i.e., dexterity and flexibility, while maintaining breathability and providing improved cut resistance. The laminate of the invention desirably includes a substrate to which a foamed surface is applied, the porous foamed surface serves to provide a combined gripping and breathable property to the surface without interfering with internal surface properties of the glove or liner being coated. The degree of safety involved when using work gloves formed according to the invention is extraordinary as compared to prior art textured surfaces. At the same time an enhanced suppleness is built into articles of clothing including work gloves, making them more comfortable in the work environment.

This is achieved by applying the foamed coating to an outer surface of each glove or article of apparel. For application to gloves, it is desirable, but not by way of limitation, that the gloves are loaded onto forms, as previously described, for this purpose. The foam is low density and, therefore, does not absorb unduly into the material of the glove or liner material. Nevertheless, the foam provides an evenly coated surface. By providing a foam having a specific degree of mechanically foamed air content therein, the individual cells forming the surfaces break, leaving a fine coating on the surface which is flexible, but, nevertheless, has a degree of texture as desired for providing a gripping type surface. It will be appreciated, in this connection, that with the invention here, depending upon the material of the coating and the degree of foaming, larger or smaller cells will be formed in the coating which break to form greater or lesser texture on the surface. Subsequent curing causes the broken cell structure to have a comparatively "hard" finish for gripping, while at the same time providing breathability and flexibility.

As discussed above, such coatings may include a liquid coating applied to the substrate by dipping or other procedures including knife applications. Such continuous or non-continuous coatings protect the wearer of work gloves, for example, from the dangers involved in the work environment by providing good abrasion and cut resistances. The material forming the foamed surface portion of the laminate, in accordance herewith, as discussed above, may include nylon, vinyl, plastic, such as polypropylene, polyethylene, polyurethane, polyvinyl chloride, acrylonitrile, natural or synthetic rubber, and so forth.

The solids content of the foamed material is mixed with water, as discussed in more detail below, to have a final total solids content within the range of between about 5 to 75 percent and desirably about 10 to 30 percent. The material is foamed either by mechanical or chemical means. It is desirably foamed by mechanical means to have an air content within the range of between about 40 to 95 percent. More desirably, the range is about 60 to 80 percent. Better abrasion resistance is obtained with a lower air content within the ranges noted above, while better grip and less abrasion resistance is obtained with an air content of a higher percent within the ranges noted above. If a coated substrate is utilized the coating will be selected to the compatible with the subsequently applied foam surface layer. Representative coatings applied to the substrates of the invention include polyvinyl chloride, acrylonitrile, natural rubbers or synthetic rubbers.

Generally, however, the entire glove 10, loaded on a form in a conventional manner, and desirably, but not by way of limitation, the finger portions 18 and thumb portion 20, or, alternatively, substantially the entire glove 10, is first dipped into a solution comprising a calcium nitrate coagulant (about 10 to about 40%), or a glacial acetic acid, or a divalent salt. This solution may also include surfactants and process aides. Surfactants may include sulfate based surfactants, anionic or nonionic surfactants, a sodium dodecylbenzenesulfonate based (SDBS) surfactant. Process aides may include Surfynol TG, Surfynol 465, bevaloid-type wetting agents, and defoamers.

The glove 10 is then dipped, as described previously, into, desirably, a nitrile solution which consists of acrylonitrile butadiene, surfactants, and process aides. The solution, when used with an acrylonitrile, may include nitrile aides. Such nitrile aides may include sulfur (about 0.25 to about 2 phr (parts per hundred "phr")), zinc oxide (about 0.25 to about 5 phr), and accelerators (about 0.25 to about 5 phr). The nitrile solution may include surfactants, accelerators, and may include a foaming additive.

After the glove is removed and rotated on the former to smooth out excess liquid, the formers holding the gloves are placed into ovens to permit the gloves to be dried and cured. Optionally, a leaching process may be used thereafter.

The non-continuous surface 22, that is, the plurality of dots 30, may be applied after the gloves 10 are dipped in a calcium nitrate coagulant, glacial acetic acid, or divalent salt solution but before the gloves 10 are dipped into the nitrile solution. Alternatively, the non-continuous surface 22 is applied after the gloves 10 are removed from the nitrile solution, but before the gloves 10 are completely dried and cured via heat or chemical cross-linking. The application of dots 30 is conducted after the gloves 10 are removed from the formers and laid on a substantially flat surface, although this method is non-limiting. Alternatively, the dots 30 may be applied when the gloves 10 positioned or are re-positioned on formers. The application of the dots 30 may be automatic via a mechanical mechanism or manually. The application of the dots 30 may be via extrusion, screen printing, or manual dotting. Each chosen non-continuous surface 22 is desirably dotted with a compound comprising a vinyl, a plastic, a polymer, and so forth. Desirably, but not by way of limitation, the compound may include a polyvinyl chloride (PVC).

With respect to the foamed coating material used for applying to the substrate for forming the article, representative such compositions are provided below. It is to be understood, however, that these representative compositions are being presented with the understanding that they are to have no limiting character on the broad disclosure as generally set forth herein and as directed to persons of ordinary skill in the art.

TABLE 1

Composition 1

| Material | Parts by Dry Weight |
|---|---|
| Polyvinyl Chloride | 100 |
| Plasticizer | 0 to 120 |
| Surfactant | 1 to 5 |
| Pigment | 1 |
| Thickener | 5 |

TABLE 2

Composition 2

| Material | Parts by Dry Weight |
|---|---|
| Acrylonitrile Latex | 30-100 |
| Surfactant | 0 to 1 |
| Processing Aides (each) | 0.25-5 |
| Pigment, Thickener | 5 |

TABLE 3

Composition 3

| Material | Parts by Dry Weight |
|---|---|
| Polyurethane Latex | 100 |
| Crosslinking Agent | 5 |
| Surfactant | 3 |
| Pigment | 1 |
| Thickener | 1 |

Once the foamed layer is applied, it is cured by conventional means including the application of heat, or by chemical cross-linking.

EXAMPLE 1

A dipping compound was prepared having the following formulation previously described herein, and included in Composition 2—Table 2. Sufficient water was added to bring the total solids of the prepared compound to about 15%. Air was incorporated into the compound by means of a wire wisk attached to an air mixer to bring about a final compound comprising about 70% air and 30% compound by volume.

Gloves formed from a knitted substrate were loaded on forms in the usual manner and dipped first in the calcium nitrate coagulant compound which included surfactants and process aides. The gloves were then dipped in the nitrile compound and withdrawn. The air incorporated into the compound causes "breaking" of the cells and excess compound drips off the gloves during a dwell period of about three minutes.

A polymer (PVC) dot application was manually conducted to position dots within the size and disposition described herein. The coated gloves on the forms were then indexed to an upright position, and moved in the line through an oven for exposure to a temperature of about 280 degree F. for about 30 minutes.

After curing, the gloves were stripped from the forms. The gloves were found to be "breathable" and tested for abrasion resistance, under conventional test procedures the gloves were found to have a longer wearing life then the uncoated gloves, with superior abrasion and cut resistance.

While the methods and products herein disclosed form preferred embodiments of the invention, this invention is not limited to those specific methods and products, and changes can be made therein without departing from the scope of the invention, which is defined in the appended claims. For example, as will be appreciated by practitioners-in-the-art, various polymeric coatings may be utilized selected from a wide variety of polymers in order to have an ultimate surface of varying properties and appearance depending upon the application of the apparel which may be formulated. Also, it will be appreciated that a substrate may be formed to provide, initially, a roughened surface to which the foamed material is applied in order to provide a combination textured gripping surface.

The present embodiment provides an improved abrasion and cut resistant surface for work gloves and other wearing apparel. The surface of the invention provides a porous surface particularly useful in work environments where it is necessary for a workman to use gloves, but which gloves are breathable and have moisture absorbing properties.

The resulting foam surface is continuous but somewhat porous, as will be understood, and has an enhanced gripping property while at the same time having the flexible, easily manipulatable and comfortable properties of a knitted wool glove. The foam may be comprised of polyurethane, for example, polyvinyl chloride, acrylonitrile, neoprene, or other synthetic or natural rubbers. In addition, in certain applications, it may be appropriate to include a moisture barrier between the substrate and the foam surface. The barrier may be applied as a coating on the substrate, for example. The moisture barrier layer will be selected to be compatible with the subsequently applied substantially continuous surface and/or substantially non-continuous surface.

As illustrative of a procedure for providing such a textured substrated surface for the subsequent application of the foamed material, in accordance herewith, reference is made to U.S. Pat. No. 4,359,783 which is incorporated herein by reference in its entirety for all purposes. The development of a roughened textured substrate in accordance with the teachings of that application may be useful, depending upon the subsequent use to which an article formed in accordance with this invention is to be used. That is, a surface which is porous and provides in addition, a textured gripping action will enhance the ability of a workman, for example, to grip and hold objects in the work environment.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the invention.

What is claimed is:

1. A glove, comprising:

a substrate configured to include four finger portions, a thumb portion, a palm portion and a back of hand portion which cooperate to cover a human hand, each finger portion and thumb portion having a substantially continuous surface positioned on a portion of the substrate which surrounds each end of each respective finger portion and thumb portion, and a non-continuous surface positioned on a portion of the substrate which substantially covers the palm portion and the back of hand portion, wherein the glove is formed to be an ambidextrous glove, and wherein an uncoated area is positioned between the end of each substantially continuous surface and the palm portion and the back of hand portion, the uncoated area surrounding at least a portion of each finger portion and thumb portion.

2. The glove of claim 1, wherein the substrate comprises a knitted material.

3. The glove of claim 2, wherein the knitted material comprises UHMPE.

4. The glove of claim 1, wherein the substrate comprises a non-woven material.

5. The glove of claim 1, wherein the substantially continuous surface comprises an acrylonitrile.

6. The glove of claim 1, wherein the substantially non-continuous surface comprises a plurality of dots.

7. The glove of claim 6, wherein the plurality of dots comprise a plastic.

8. The glove of claim 7, wherein the plurality of dots comprise polyvinyl chloride.

9. The glove of claim 6, wherein each of the plurality of dots has a diameter in a range of about 1 to 5 mm.

10. The glove of claim 6, wherein each of the plurality of dots is spaced about 1 to about 5 mm apart.

11. The glove of claim 6, wherein each of the plurality of dots has a height of about 0.5 to about 2 mm.

12. The glove of claim 6, wherein a space in a range of about 1 to 3 mm is positioned between each of the plurality of dots.

13. The glove of claim 6, wherein the plurality of dots comprise an acrylonitrile.

14. A glove, comprising:

a knitted substrate configured to include four finger portions, a thumb portion, a palm portion and a back of hand portion which cooperate to cover a human hand, each finger portion and thumb portion having a substantially continuous surface positioned on a portion of the substrate which surrounds each end of each respective finger portion and thumb portion, the substantially continuous surface comprising an acrylonitrile, a non-continuous surface positioned on a portion of the substrate which substantially covers the palm portion and the back of hand portion, the non-continuous surface comprising a plurality of dots, and an uncoated area of the substrate positioned between an end of each substantially continuous surface and the non-continuous surface positioned on at least a portion of the palm portion and the back of hand portion, the uncoated area of substrate surrounding at least a portion of each finger portion and thumb portion wherein the glove is formed to be an ambidextrous glove.

15. The glove of claim 14, wherein the knitted material comprises UHMPE.

16. The glove of claim 14, wherein the plurality of dots comprise a plastic.

17. The glove of claim 16, wherein the plurality of dots comprise polyvinyl chloride.

18. The glove of claim 16, wherein each of the plurality of dots has a diameter in a range of about 1 to 5mm.

19. The glove of claim 16, wherein each of the plurality of dots is spaced about 1 to about 5 mm apart.

20. The glove of claim 16, wherein each of the plurality of dots has a height of about 0.5 to about 2 mm.

21. The glove of claim 16, wherein a space in a range of about 1 to 3 mm is positioned between each of the plurality of dots.

22. The glove of claim 14, wherein the plurality of dots comprise an acrylonitrile.

23. A glove, comprising:

a substrate configured to include four finger portions, a thumb portion, a palm portion and a back of hand portion which cooperate to cover a human hand, each finger portion and thumb portion having a substantially continuous surface positioned on a portion of the substrate which surrounds each end of each respective finger portion and thumb portion, a non-continuous surface positioned on a portion of the substrate which substantially covers the palm portion and the back of hand portion, and an uncoated area of the substrate positioned between an end of each substantially continuous surface and the non-continuous surface positioned on at least a portion of the palm portion and the back of hand portion, the uncoated area of substrate surrounding at least a portion of each finger portion and thumb portion, where said non-continuous surface comprises a plurality of spaced-apart dots and a plurality of areas positioned between said dots, where said substrate is visually discernable in said plurality of areas positioned between said dots, and where the glove is formed to be an ambidextrous glove.

24. The glove of claim 23, wherein the plurality of spaced-apart dots comprise an acrylonitrile.

* * * * *